US005134930A

United States Patent [19]

Mei-Hwa

[11] Patent Number: 5,134,930

[45] Date of Patent: Aug. 4, 1992

[54] INFLATABLE SERVING TRAY

[76] Inventor: Hsieh Mei-Hwa, 6 F, No. 4-2, Lane 66, Alley 669, Tung Hua S. RD, Taipei, Taiwan

[21] Appl. No.: 732,023

[22] Filed: Jul. 18, 1991

[51] Int. Cl.[5] ..... A47B 23/00

[52] U.S. Cl. ..... 108/42; 108/43; 206/522

[58] Field of Search ..... 108/43, 42, 50; 206/562, 563, 564, 522

[56] References Cited

U.S. PATENT DOCUMENTS

| | | | |
|---|---|---|---|
| 3,366,231 | 1/1968 | Trakas | 206/527 |
| 3,701,576 | 10/1972 | Moen | 108/43 X |
| 4,044,867 | 8/1977 | Fisher | 206/522 X |
| 4,765,463 | 8/1988 | Chanel | 206/564 X |
| 5,005,702 | 4/1991 | Davis et al. | 108/43 X |

FOREIGN PATENT DOCUMENTS

| | | | |
|---|---|---|---|
| 2385606 | 12/1978 | France | 206/522 |
| 1179466 | 1/1970 | United Kingdom | 206/522 |

*Primary Examiner*—Jose V. Chen

*Attorney, Agent, or Firm*—Lowe, Price, LeBlanc & Becker

[57] ABSTRACT

An inflatable serving tray for holding meals is described. The tray has a base sheet with a rigid base portion at the bottom, an upper sheet at the top and the sheets are peripherally connected by an internal strip and an external strip, and two leg portions are attached to the base sheet at the bottom on opposite sides thereof. The internal strip has an air valve therein through which air is admitted into the air chamber defined within the upper and base sheets and the legs and internal and external strips. By the use of the air valve, the serving tray can also be deflated for storage when not in use.

1 Claim, 5 Drawing Sheets

INFLATABLE SERVING TRAY

BACKGROUND OF THE INVENTION

The present invention relates to a serving tray and relates more particularly to an inflatable serving tray which can be conveniently set up into a specific shape and retained in place to hold foods and beverages for eating.

In various conditions or due to some reasons, people may be unable to sit down at a meal. It is very difficult to enjoy a large and satisfying meal while one is lying in bed, relaxing outdoors, watching sports or sitting in an operating motor vehicle. The present invention is designed to help people enjoy a satisfying meal, while on the move.

SUMMARY OF THE INVENTION

The present invention is to provide a serving tray made from PVC or soft plastic material which can be inflated into shape and be positioned on a person's lap for holding foods and various beverages. This item can be deflated to reduce space when not in use.

DETAILED DESCRIPTION OF THE PREFERRED EMBODIMENT

Figure 1:
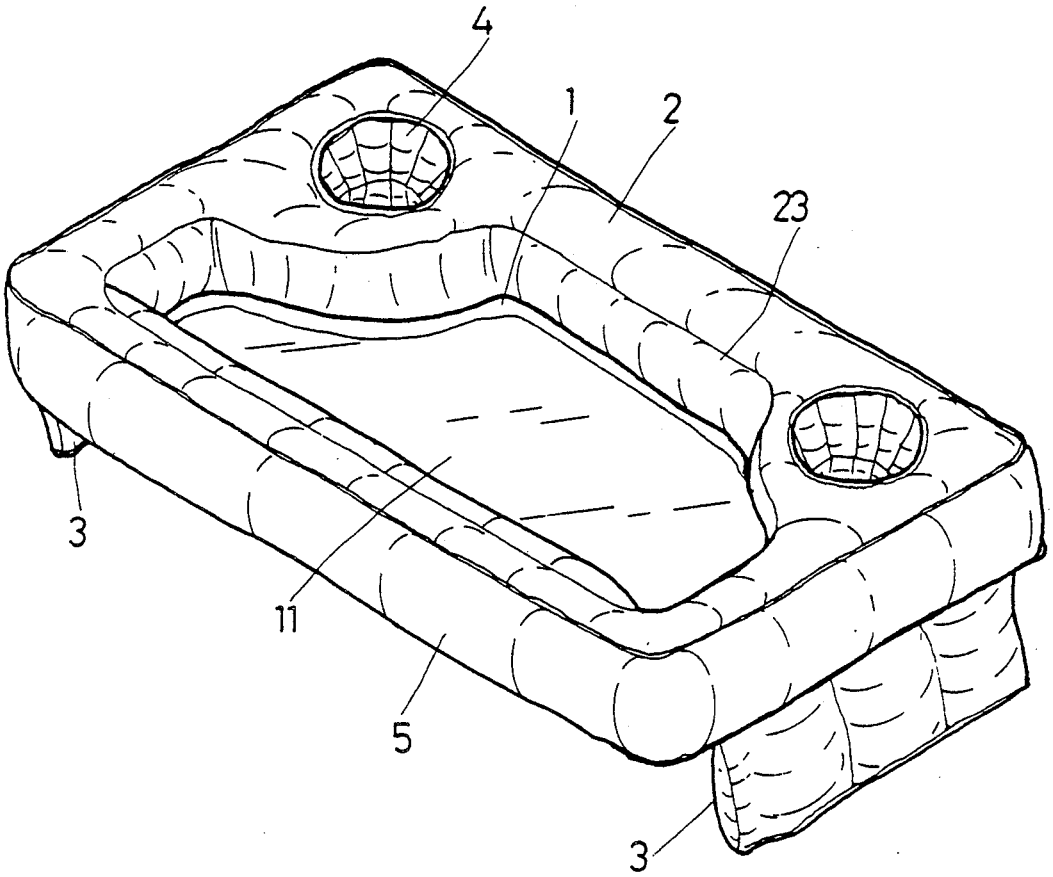
FIG. 1 is a perspective view of the preferred embodiment of the serving tray of the present invention.
Figure 2:
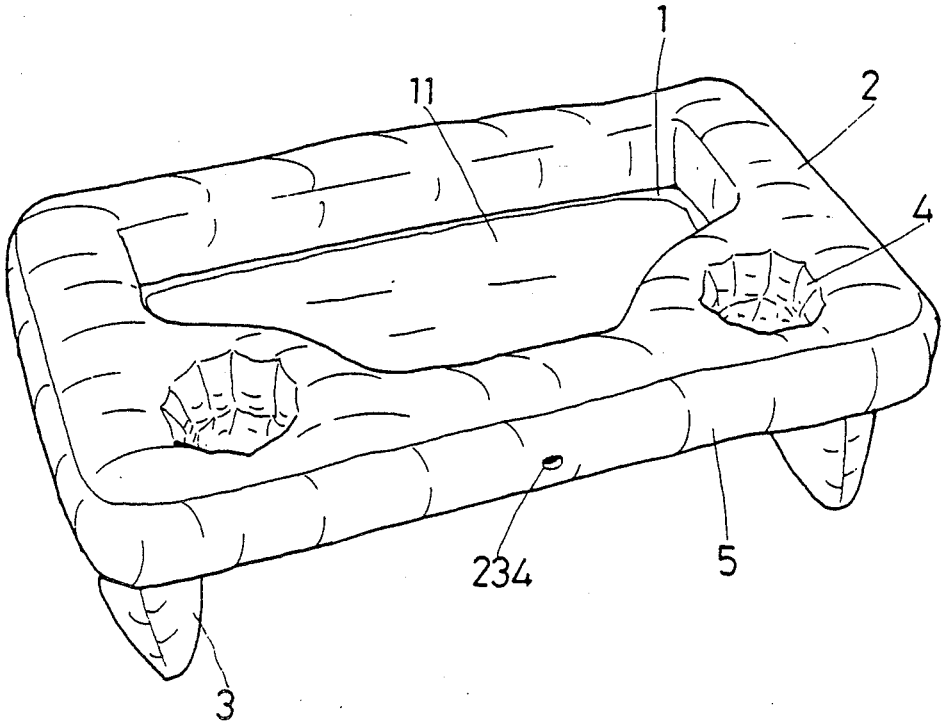
FIG. 2 is another perspective view thereof taken from another direction.
Figure 3:
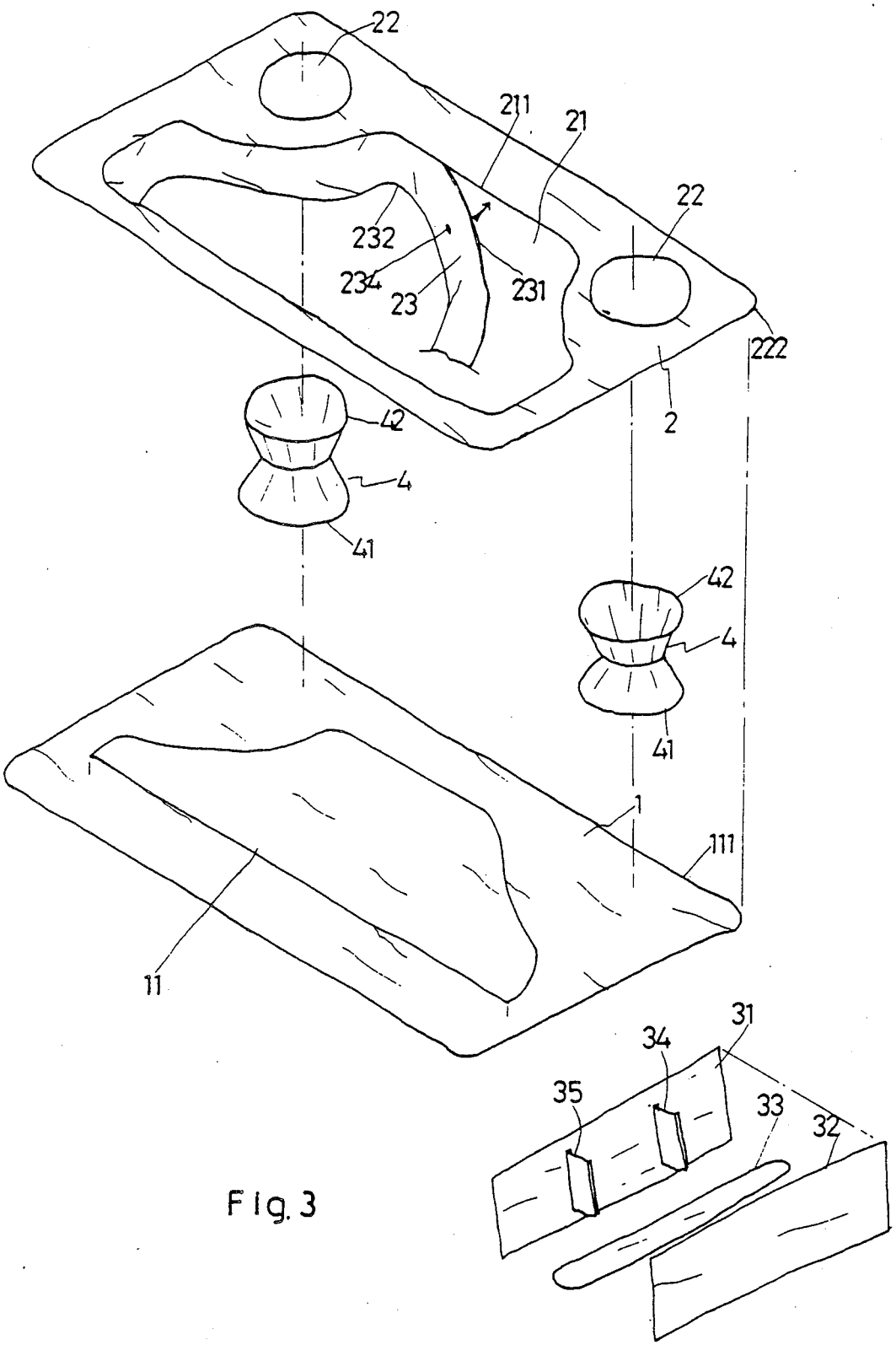
FIG. 3 is an exploded perspective view thereof.

Referring to FIGS. 1, 2 and 3, therein illustrated is the preferred embodiment of the preferred embodiment of the present invention which is generally comprised of a base sheet 1, an upper sheet 2, a pair of legs 3 and a pair of holder members 4 which are respectively made from PVC or soft plastic material. The rectangular base sheet has a rigid strip 11 in a trapezoidal shape covered thereon at the top and fixed secured by high frequency melting to reinforce the strength of the structure thereof. The upper sheet 2 which is made in shape and size suitable for covering over the base sheet 1 has an opening 21 at the middle corresponding to the rigid strip 11 on the base sheet 1 and two through-holes 22 at two opposite corners. Each leg 3 is shaped like a canoe having an opening at the top, which is comprised of two side panels 31 and 32 at two opposite sides, a bottom panel 33 at the bottom and a plurality of ribs 34 and 35 traversely connected between said two side panels 31 and 32. The two side panels 31 and 32, the bottom panel 33 and the ribs 34 and 35 are connected into shape through the process of high frequency melting. Each holder member 4 is comprised of two hopper-like portions 41 and 42 invertedly connected together.

Figure 4:
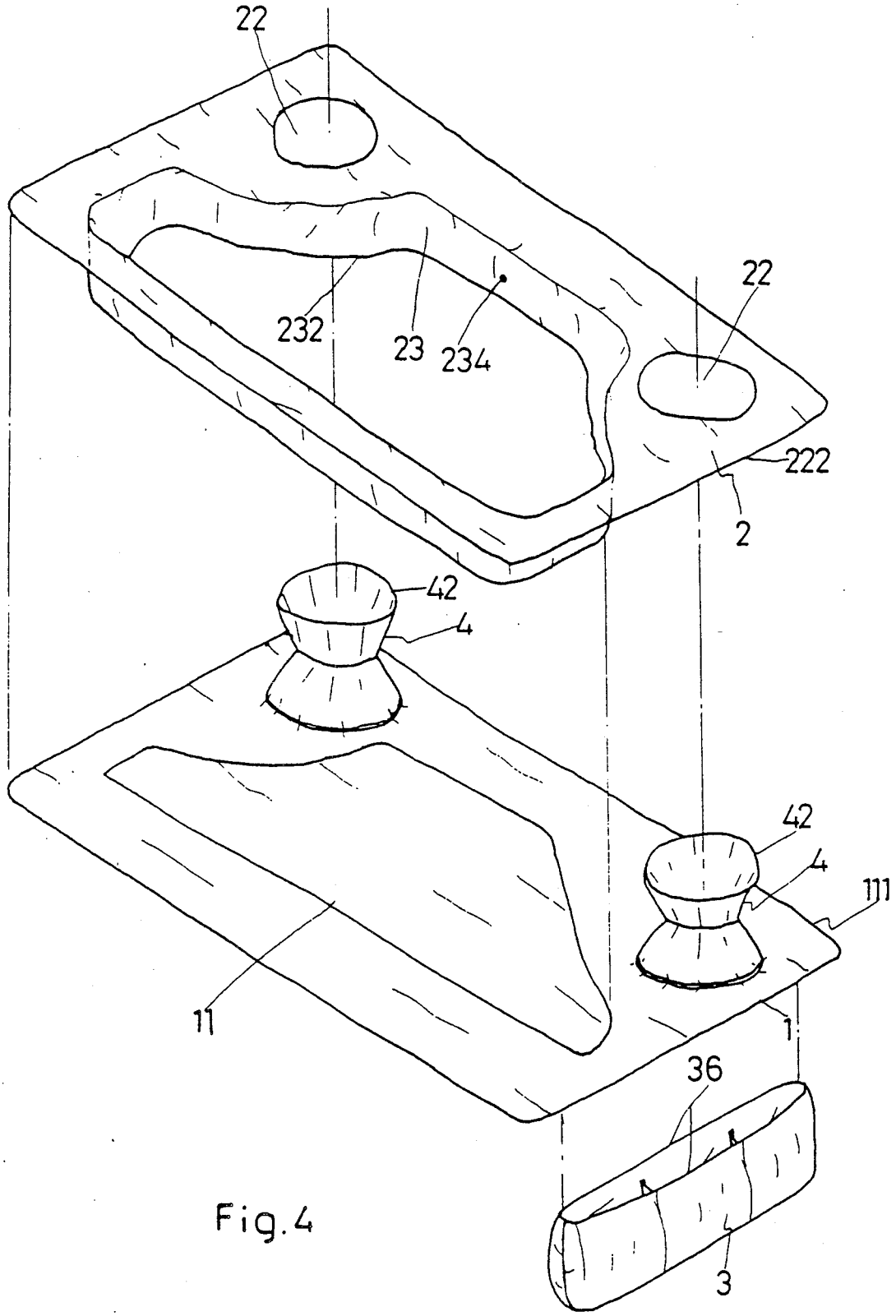
FIGS. 4 and 5 illustrates the assembly procedure of the present invention.
Figure 5:
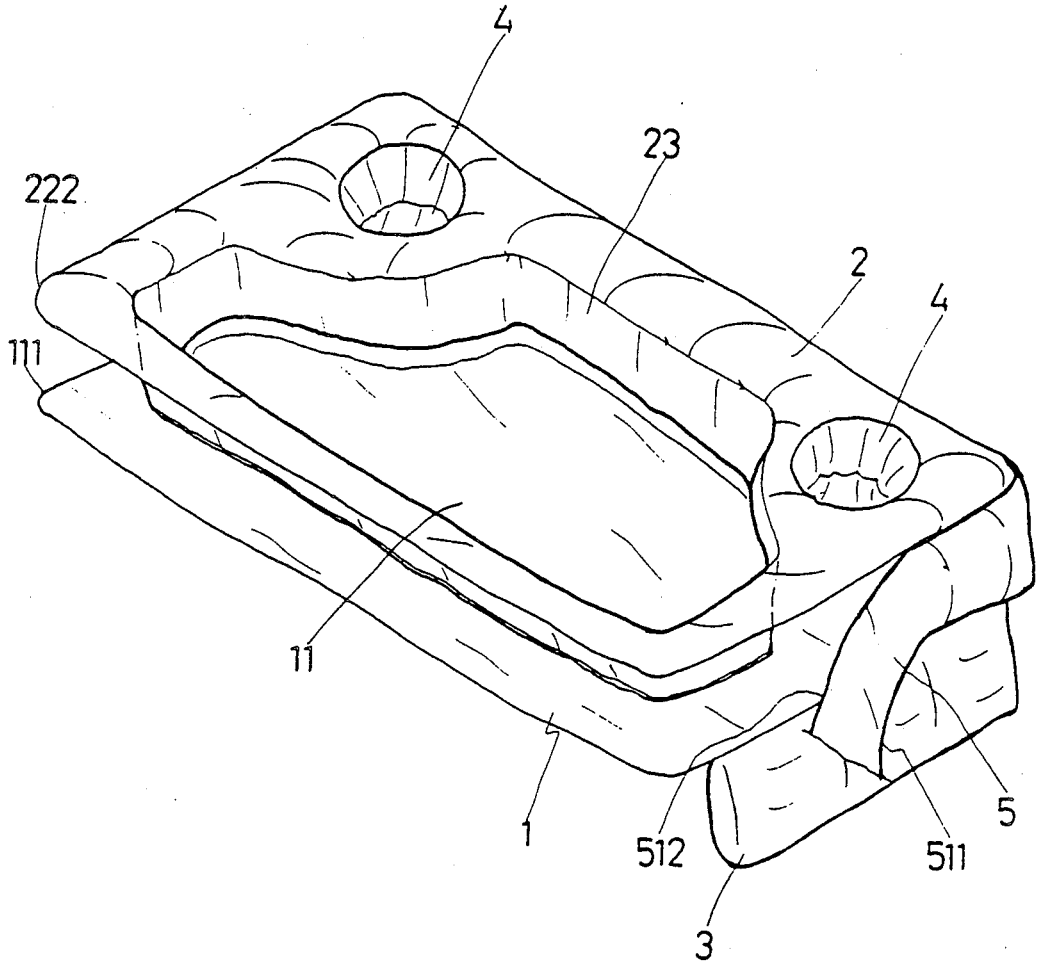

Referring to FIGS. 4 and 5, the two legs 3 are respectively connected to the base sheet 1 at the bottom on two opposite side at right angles by connecting the top edge 36 around the top opening of each leg 3 to the bottom surface of the base sheet 1 through the process of high frequency melting. Then, the two holder members 4 are respectively connected to the base sheet 1 at the top and two opposite corners by sealing the peripheral edge of the first hopper-like portions 41 of each holder member 4 to the top surface of the base sheet 1 through the process of high frequency melting. The upper sheet 2 is then attached with a narrow strip 23 by connecting the top edge 231 of said narrow strip to the peripheral edge 211 of the opening 21 on the base sheet 1. Then, the upper sheet 2 is attached to the two holder members 4, which are fixed to the base sheet 1 at the top, and by connecting the peripheral edge around each hole 22 on the upper sheet 2 to the peripheral edge of the second hopper portion 42 of each holder member 4 respectively. Once the upper sheet 2 has been connected to the two holder members 4, the bottom edge 232 of the narrow strip 23 is then connected to the base sheet 1 around the rigid strip 11 forming a recessed area on the rigid strip 11 within the opening 21. Also attached is a side strip 5 to the base sheet 1 and the upper sheet 2 by connecting the top edge 512 of said side strip 5 to the peripheral edge 222 of the upper sheet 2 and connecting the bottom edge 511 of said side strip 5 to the peripheral edge 111 of the base sheet 1. Thus, the narrow strip 23, the upper sheet 2, the base sheet 1 and the side strip 5 comprise an air tight chamber. Therefore, an air valve 234 may be attached to the narrow strip 23 for the infiltration of air to a tight chamber to inflate the serving tray. The air in the air tight chamber can be released, so that the serving tray can collapse to reduce space when not in use. Further, it is to be understood that all the aforesaid connecting processes are preformed through the process of high frequency melting.

What is claimed is:

1. An inflatable serving tray made from plastic material and inflatable into a predetermined shape for holding foods and beverages comprising:

a rectangular base sheet;

a trapezoidal shaped rigid board having dimensions smaller than said base sheet and fixed to said base sheet at the center thereof;

an upper sheet disposed over said base sheet, said upper sheet having an opening in the center corresponding to the dimensions of said rigid board and two beverage holder openings in upper right and upper left corners respectively;

two beverage holders are respectively connected between said base sheet and said upper sheet, each holder comprised of an upper hopper-like portion and an inverted, lower hopper-like portion connected thereto in an hour glass configuration, the periphery of the lower portion being fused to said base sheet and the peripheral edge of the upper portion of said two beverage holders being fused to the surface of the holder openings on said upper sheet respectively;

two inflatable leg members each respectively attached to said base sheet at the bottom thereof and on opposite sides to support said base sheet and said upper sheet, each member comprising two side panels depending vertically from opposite side portions of said base sheet, a bottom panel attached horizontally connecting lower edges of said panels and a plurality of ribs laterally connected between each of said two panels, each of said two side panels having two vertical end edges respectively connected to each other and to said bottom panel;

a first narrow strip having a top edge connected to said upper sheet and extending around said opening and a bottom edge connected to said base sheet surrounding said rigid board, said first narrow strip having an air valve fastened therein;

a second narrow strip having a top edge connected to said upper sheet around the outer peripheral edge thereof and a bottom edge is connected to said base sheet around the peripheral edge thereof whereby said first and second narrow strips define with the said base and upper sheets an air-tight chamber into which air is admitted through said air valve.

* * * * *